US008305406B2

(12) United States Patent
Komatsu et al.

(10) Patent No.: US 8,305,406 B2
(45) Date of Patent: Nov. 6, 2012

(54) IMAGE FORMING DEVICE

(75) Inventors: Shin Komatsu, Kanagawa (JP); Masanori Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 269 days.

(21) Appl. No.: 12/880,845

(22) Filed: Sep. 13, 2010

(65) Prior Publication Data

US 2011/0236073 A1 Sep. 29, 2011

(30) Foreign Application Priority Data

Mar. 26, 2010 (JP) ..... 2010-073358

(51) Int. Cl.
*G03G 13/04* (2006.01)

(52) U.S. Cl. ..... 347/130

(58) Field of Classification Search ..... None
See application file for complete search history.

(56) References Cited

U.S. PATENT DOCUMENTS

2009/0162091 A1 6/2009 Yokoi
2009/0169260 A1 7/2009 Yokoi

FOREIGN PATENT DOCUMENTS

JP 2006-088598 A 4/2006
JP 2009-154327 A 7/2009
JP 2009-154413 A 7/2009
JP 2009-157001 A 7/2009

*Primary Examiner* — Stephen Meier
*Assistant Examiner* — Tracey McMillion
(74) *Attorney, Agent, or Firm* — Sughrue Mion, PLLC

(57) ABSTRACT

An image forming device that includes a plurality of exposure components and a conductive covering member is provided. Pluralities of light emitting elements are disposed on substrates at the plurality of exposure components. The exposure components expose a plurality of exposure objects, respectively. The conductive covering member includes at least a floor plate that covers the exposure components from below. Wiring is connected to the substrates being disposed along the floor plate. Earthing portions of the substrates are electrically connected to the floor plate. The covering member includes a side plate that covers an axial direction side of the exposure objects and is joined to the floor plate. The earthing portions of the substrates are electrically connected to the side plate via conductive members.

4 Claims, 6 Drawing Sheets

IMAGE FORMING DEVICE

CROSS-REFERENCE TO RELATED APPLICATIONS

This application is based on and claims priority under 35USC 119 from Japanese Patent Application No. 2010-073358 filed on Mar. 26, 2010.

BACKGROUND

1. Technical Field

The present invention relates to an image forming device.

2. Related Art

There is an image forming device in which an exposure unit frame with conductivity retains an LED head and the exposure unit frame is electrically earthed.

SUMMARY

According to an aspect of the invention, an image forming device is provided. The image forming device includes: a plurality of exposure components at which pluralities of light emitting elements are disposed on substrates, the exposure components exposing a plurality of exposure objects, respectively; and a conductive covering member including at least a floor plate that covers the exposure components from below, wiring connected to the substrates being disposed along the floor plate, and earthing portions of the substrates being electrically connected to the floor plate.

BRIEF DESCRIPTION OF THE DRAWINGS

An exemplary embodiment of the present invention will be described in detail based on the following figures, wherein.

DETAILED DESCRIPTION

Figure 1:
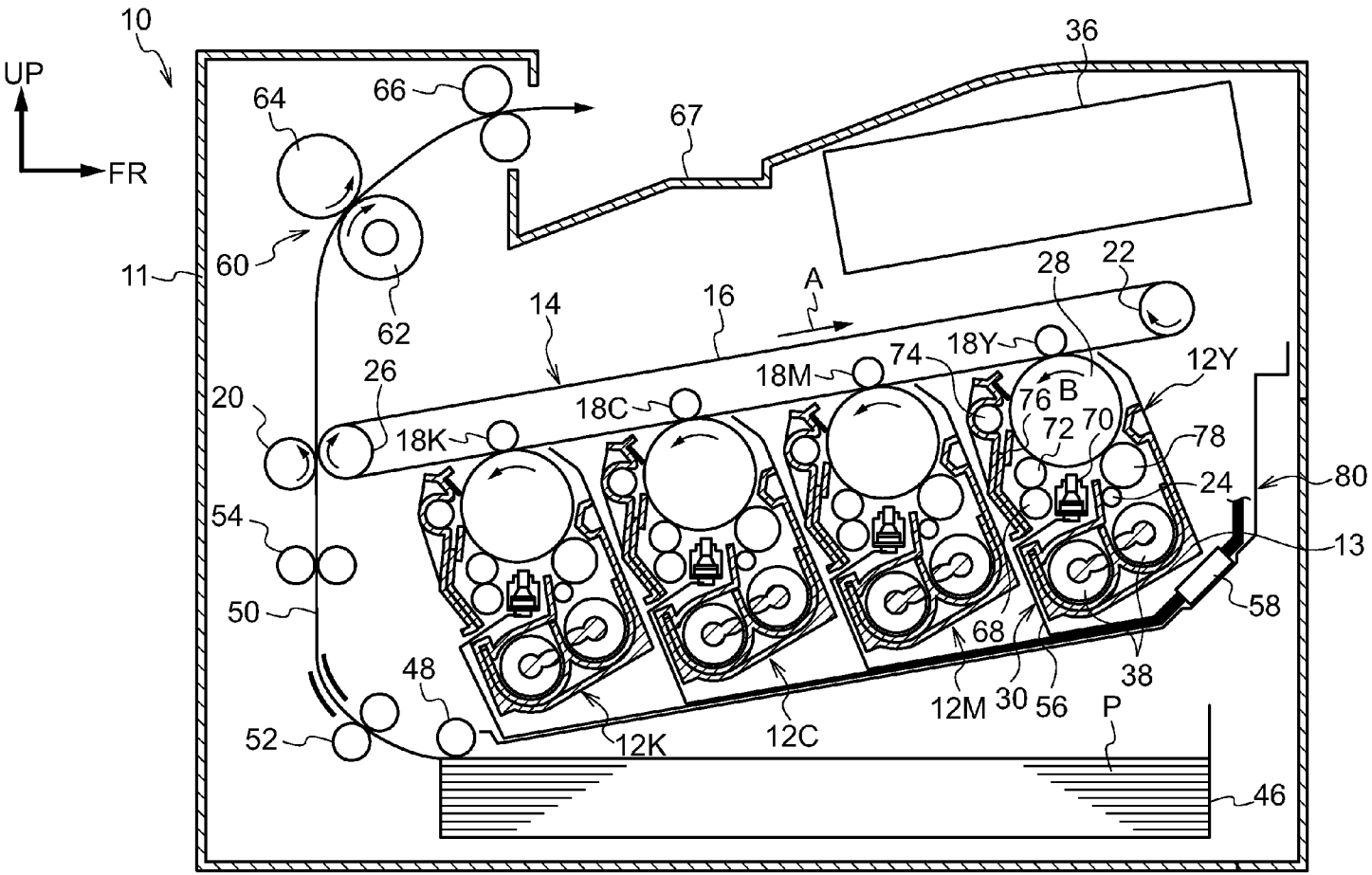
FIG. 1 is a schematic side view illustrating overall structure of an image forming device relating to a present exemplary embodiment.

Herebelow, an exemplary embodiment of the present invention is described in detail on the basis of the example illustrated in the attached drawings. Herein, for convenience of description, the arrow FR shown in FIG. 1 represents a forward direction of an image forming device 10 and the arrow UP represents an upward direction of the image forming device 10. Thus, the side at which a below-described paper conveyance path 50 is provided is a rear side of the image forming device 10.

As illustrated in FIG. 1, image forming units 12Y, 12M, 12C and 12K are arranged in a direction diagonally downward to the rear (downward to the left in the drawing) at the middle of the interior of a casing 11 of the image forming device 10. The image forming units 12 are examples of image forming components that perform image formation with toners (developers) of the four colors yellow (Y), magenta (M), cyan (C) and black (K). The order of arrangement of the image forming units 12 is Y, M, C, K from upper front to lower rear (from the upper right to the lower left in the drawing).

The image forming units 12Y to 12K have the same structures as one another except for the colors of the toners accommodated therein. Therefore, in the following descriptions, descriptions are given with reference numerals in which the letters Y, M, C and K are appended to numerals in order to distinguish between the colors yellow, magenta, cyan and black, and when there is no need to distinguish between the colors, the letters Y, M, C and K are omitted after the numerals.

A transfer unit 14 is disposed above the image forming units 12Y to 12K. The transfer unit 14 transfers toner images (an image) formed by the image forming units 12Y to 12K onto recording paper P. The transfer unit 14 is structured to include an endless intermediate transfer belt 16, four first transfer rollers 18Y, 18M, 18C and 18K, and a second transfer roller 20. The first transfer rollers 18Y, 18M, 18C and 18K are disposed at the inner side of the intermediate transfer belt 16 and superposingly transfer the respective toner images from the image forming units 12Y to 12K onto the intermediate transfer belt 16. The second transfer roller 20 is for transferring the superposed toner images on the intermediate transfer belt 16 onto the recording paper P.

The intermediate transfer belt 16 is wound round a driving roller 26 and a support roller 22. The driving roller 26 is disposed to oppose the second transfer roller 20 and is driven by a motor. The support roller 22 is rotatably supported. When the driving roller 26 is driven by a motor and rotates, the intermediate transfer belt 16 moves to turn in the direction of arrow A (the clockwise direction in the drawing).

Each of the first transfer rollers 18Y to 18K is disposed to oppose a photoreceptor 28 of the respective image forming unit 12Y to 12K, sandwiching the intermediate transfer belt 16. The photoreceptor 28 serves as an example of a below-described exposure object. Transfer voltages of a polarity opposite to a toner polarity (for example, of a positive polarity in the present exemplary embodiment) are applied to the first transfer rollers 18Y to 18K.

A transfer voltage of the polarity opposite to the toner polarity is also applied to the second transfer roller 20. A cleaning device is provided at the outer peripheral face of the intermediate transfer belt 16 at the position at which the support roller 22 is disposed. Residual toner, paper dust and the like on the intermediate transfer belt 16 are removed by this cleaning device.

A paper supply section 46 is provided below the image forming unit 12. The recording paper P is accommodated in the paper supply section 46. The paper conveyance path 50, along which the recording paper P is conveyed, is provided in a vertical direction upward from a rear end portion of the paper supply section 46 (the left end portion in the drawing).

The paper conveyance path 50 includes a drawing roller 48, a conveyance roller 52 and a positioning roller 54. The drawing roller 48 draws the recording paper P out from the paper supply section 46. The conveyance roller 52 is constituted by a pair of rollers that convey the recording paper P. The positioning roller 54 is constituted by a pair of rollers that match up a timing of conveyance of the recording paper P with a timing of movement of the image on the intermediate transfer belt 16.

The recording paper P that is sequentially fed out from the paper supply section 46 by the drawing roller 48 passes along the paper conveyance path 50 and is conveyed to a second transfer position of the intermediate transfer belt 16 by the positioning roller 54.

A fixing unit 60 is provided on the paper conveyance path 50 at the downstream side of the second transfer roller 20 (above the second transfer roller 20). The fixing unit 60 includes a heating roller 62 and a pressure roller 64. The heating roller 62 is heated by a heat source (for example, a halogen heater). The pressure roller 64 sandwiches the recording paper P against the heating roller 62 and pressures the toner image.

An ejection roller 66 is provided on the paper conveyance path 50 at the downstream side of the fixing unit 60. The ejection roller 66 is constituted by a pair of rollers that eject the recording paper P to the outside of the casing 11 after the fixing. The recording paper P that has been ejected by the ejection roller 66 is placed on an ejection portion 67 formed on a top face of the casing 11. A control section 36 is provided at the front side of the interior of the casing 11, at an upper face (upper portion) of a ceiling plate 84, which is described below. The control section 36 controls driving of respective sections of the image forming device 10.

Figure 2:
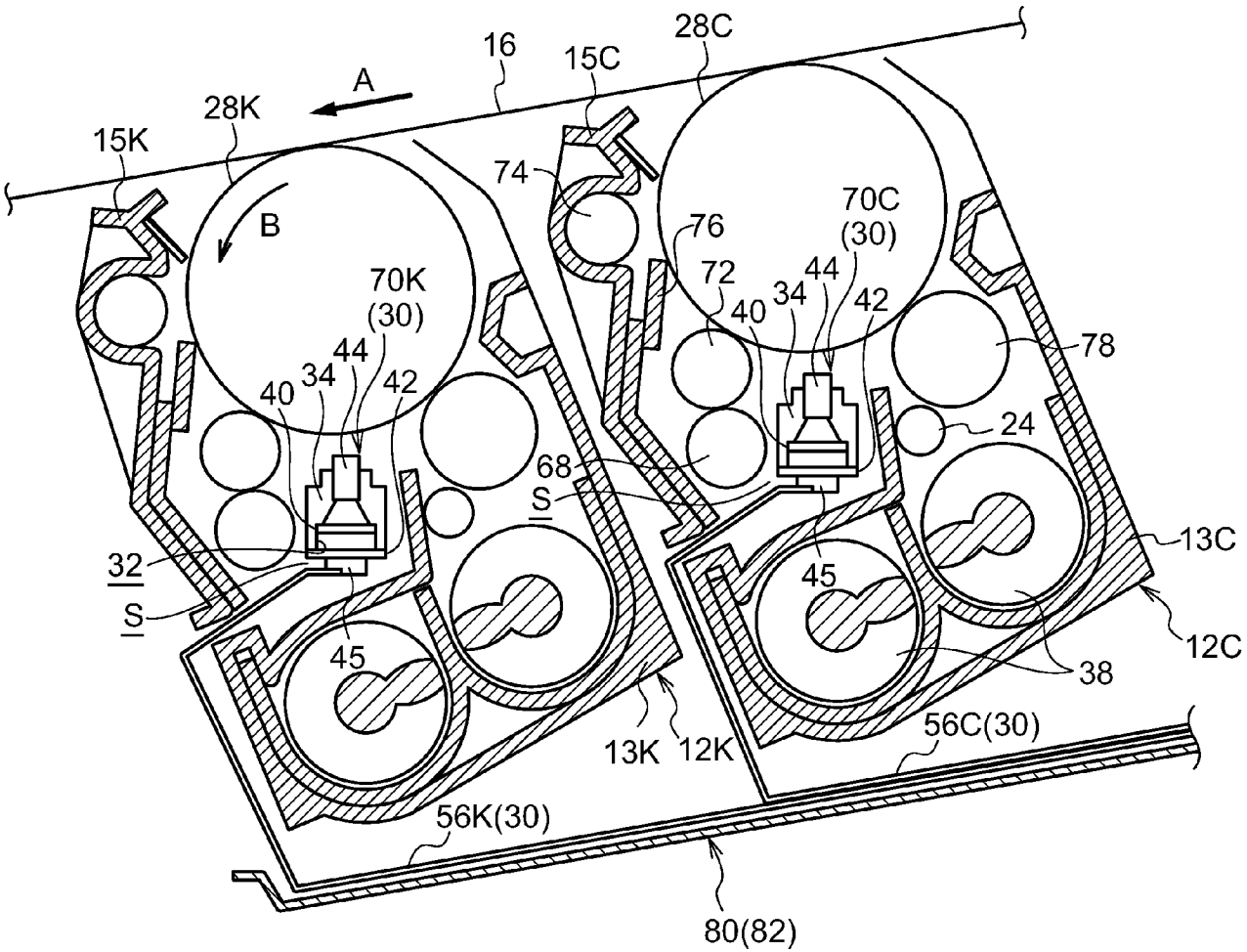
FIG. 2 is a schematic side view illustrating structure of an image forming unit.

Next, the image forming units 12 are described. As illustrated in FIG. 2, each image forming unit 12 includes the photoreceptor 28, a charging roller 72, an exposure unit 70, a developing roller 78, a de-electrification lamp 74 and a cleaning blade 76. The photoreceptor 28 is driven to rotate in the direction of arrow B (the counter-clockwise direction in the drawing). The charging roller 72 touches against and electrostatically charges an outer peripheral face of the photoreceptor 28. The exposure unit 70 serves as an example of an exposure component that illuminates exposure light onto the outer peripheral face of the photoreceptor 28 and forms an electrostatic latent image. The developing roller 78 develops the electrostatic latent image on the outer peripheral face of the photoreceptor 28 with toner. The de-electrification lamp 74 illuminates light onto and de-electrifies the outer peripheral face of the photoreceptor 28 after the transfer. The cleaning blade 76 cleans the outer peripheral face of the photoreceptor 28 after the de-electrification.

The exposure unit 70 is one structural component of an exposure device 30, which is described below. The charging roller 72, the exposure unit 70, the developing roller 78, the de-electrification lamp 74 and the cleaning blade 76 respectively oppose the outer peripheral face of the photoreceptor 28 and are arranged in this order from the upstream side to the downstream side of the direction of rotation of the photoreceptor 28.

A cleaning roller 68 is rotatably provided at the outer peripheral face of the charging roller 72, at the opposite side thereof from the photoreceptor 28. The cleaning roller 68 is for removing external additives of the toner and the like adhering to the outer peripheral face of the charging roller 72. The charging roller 72 is connected to an electrification component, is electrified during image formation while passively rotating, and charges up the outer peripheral face of the photoreceptor 28.

Two helical conveyance members 38 are provided at the lower side of the developing roller 78. The conveyance members 38 agitate (mix) developer supplied from a toner supply section (for example, a mixture of a toner made of resin and a carrier made of metal) and supply the developer to the developing roller 78. A thin layer formation roller 24 is also disposed to oppose the outer peripheral face of the developing roller 78.

The thin layer formation roller 24 is disposed at a spacing from the outer peripheral face of the developing roller 78, at the developing roller 78 rotation direction upstream side relative to the photoreceptor 28. The thin layer formation roller 24 regulates amounts of developer on the outer peripheral face of the developing roller 78 that pass the thin layer formation roller 24, forming a developer layer (a thin layer) with a pre-decided thickness on the developing roller 78.

The developing roller 78 is structured with a fixed magnetic roller and a tubular developing sleeve that is provided to be rotatable at the outer side of the magnetic roller. At a time of development, a voltage is applied and an electric field is formed between the developing roller 78 and the photoreceptor 28, and the developing roller 78, while rotating, causes the toner in the developer to migrate toward the electrostatic latent image on the photoreceptor 28.

The image forming unit 12 includes a main body portion that is structured with a lower housing 13 and an upper housing 15. The developing roller 78, the conveyance members 38 and the thin layer formation roller 24 are disposed in the lower housing 13, and the photoreceptor 28, the exposure unit 70, the charging roller 72, the cleaning roller 68, the cleaning blade 76 and the de-electrification lamp 74 are disposed in the upper housing 15.

Figure 4:
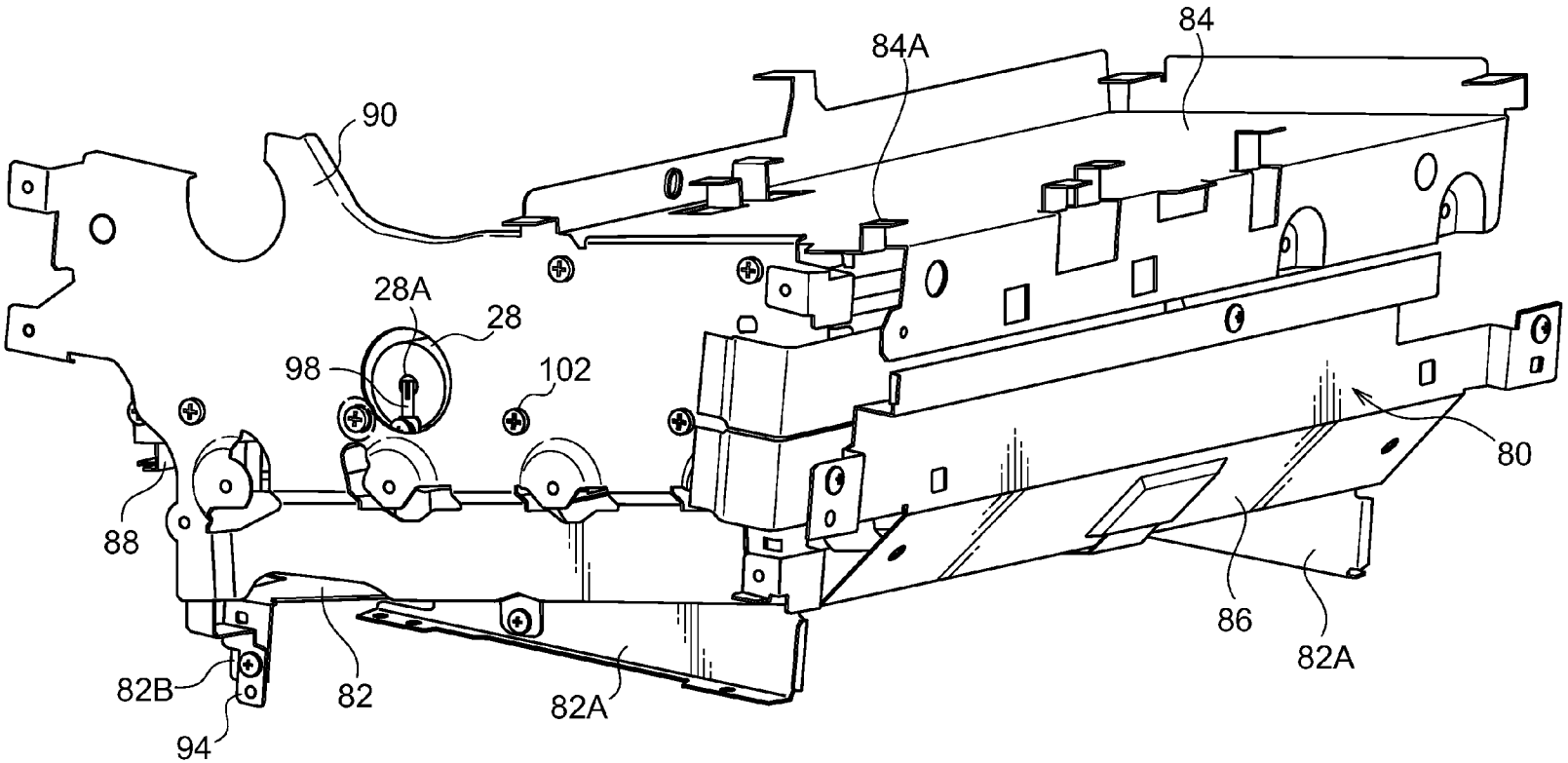
FIG. 4 is a schematic perspective view illustrating metal plates that cover an image forming unit.
Figure 5:
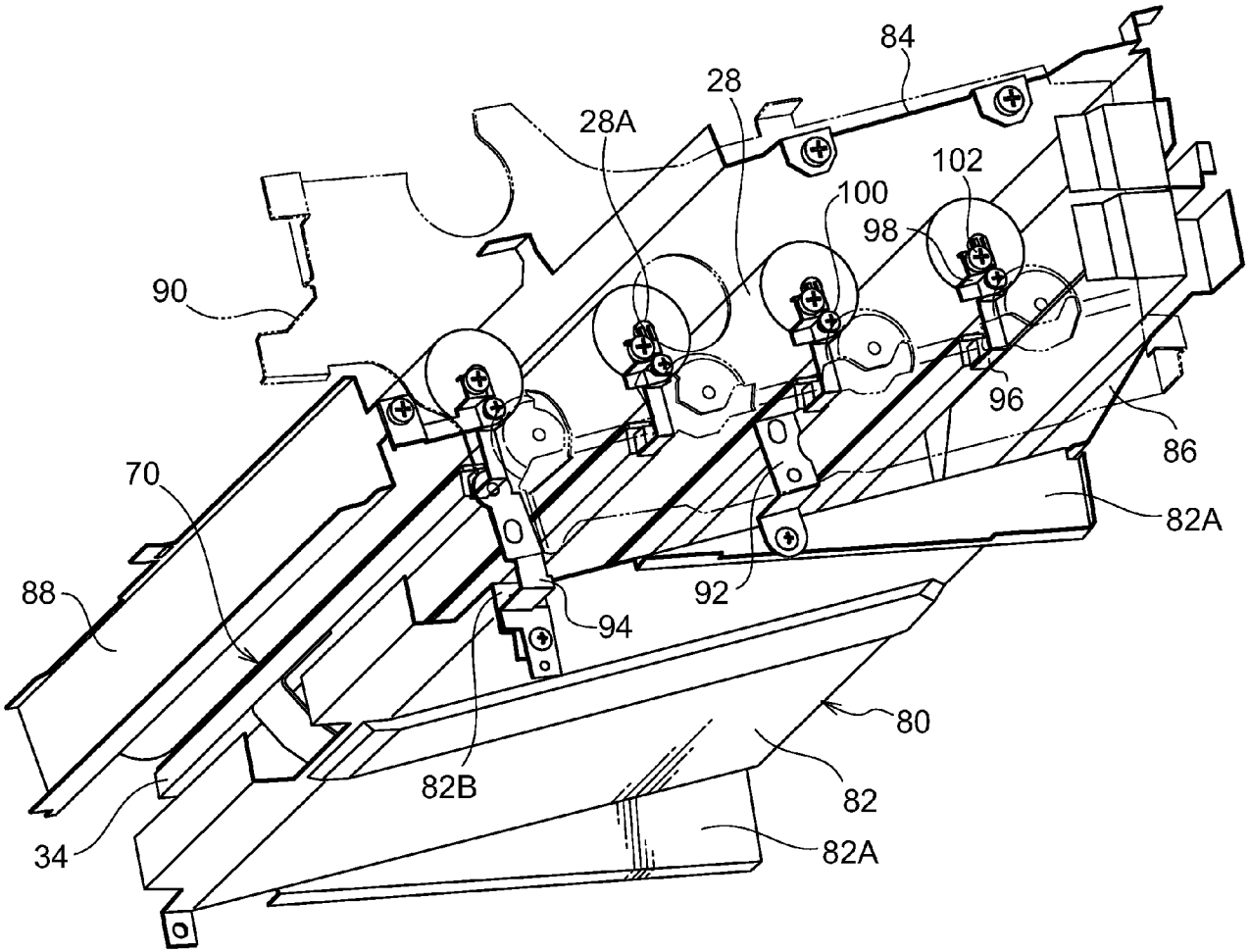
FIG. 5 is a schematic perspective view illustrating an earthing structure of exposure units and photoreceptors to a side plate.

As illustrated in FIG. 4 and FIG. 5, of the image forming units 12Y to 12K and the transfer unit 14, at least substantially the whole of a floor portion side that is a vertical direction lower side, portions of a ceiling portion side that is the vertical direction upper side, a front portion side, a rear portion side and a left portion side are covered by metal plates 80, which serve as an example of a conductive covering member. The metal plates 80 include a floor plate 82, the ceiling plate 84, a front plate 86, a rear plate 88 and a side plate 90. The front plate 86 relating to the present exemplary embodiment is formed integrally with the floor plate 82, being continuous with and extending from the floor plate 82.

The side plate 90 supports a driving system that rotatingly drives the photoreceptor 28. An upper end portion of the side plate 90 is screw-fastened to and joined with the ceiling plate 84. At a lower end portion of the side plate 90, respective one end portions of plate springs 92 and 94 made of metal are screw-fastened and attached at a front-rear direction substantially central portion and a rear end portion of the side plate 90. The plate springs 92 and 94 serve as examples of conductive resilient members. The respective other end portions of the plate springs 92 and 94 are screw-fastened and attached to, respectively, a first flange 82A and a second flange 82B that are formed at the floor plate 82.

Next, the exposure device 30 is described. As illustrated in FIG. 3B, the exposure device 30 is structured to include the exposure unit 70, which includes a holder 34, and a flexible fat cable (FFC) 56 that serves as an example of wiring, which is capable of transmitting a power supply and electrical signals to the exposure unit 70. One end of the FFC 56 is electrically connected with one end of a connector 45 that is provided at the exposure unit 70, and the other end is electrically connected with a driving circuit board.

Two length direction end portions 34A and 34B of the holder 34 of the exposure unit 70 are fixed to the lower housing 13 of the image forming unit 12, and retained such that a distance of the holder 34 from the outer peripheral face of the photoreceptor 28 is a pre-specified distance.

The exposure unit 70 is constituted with a first printed circuit board 40, a second printed circuit board 42 and a SELFOC lens array 44 being mounted at the holder 34. An array of light emitting elements which are light emitting portions (light emitting diodes, hereinafter referred to as LEDs) is provided at the first printed circuit board 40, which serves as an example of a substrate. A driver that drives the LED array is mounted on the second printed circuit board 42, which serves as an example of a substrate. The SELFOC lens array 44 is for focusing light emitted from the LED array onto the outer peripheral face of the photoreceptor 28 (see FIG. 2 and FIG. 3A). The exposure unit 70 is disposed in a space portion S (see FIG. 2) that is formed between the photoreceptor 28 and the lower housing 13.

Figure 6:
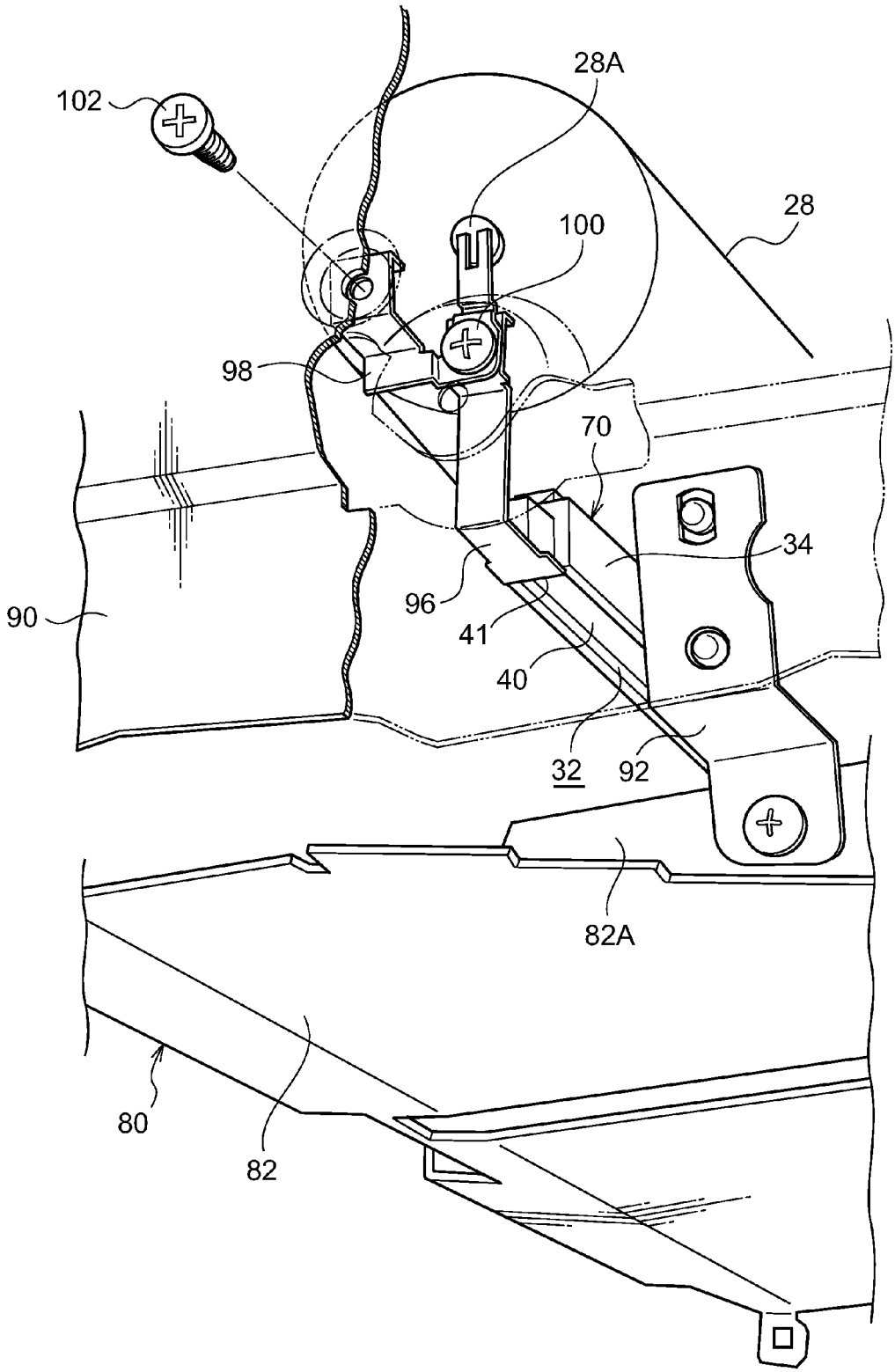
FIG. 6 is a partial magnified schematic perspective view illustrating the earthing structure of the exposure units and the photoreceptors to the side plate.

The first printed circuit board 40 is assembled into the holder 34 through an aperture portion 32 that is formed in the holder 34. An emission face of the LED array is caused to oppose the outer peripheral face of the photoreceptor 28. As illustrated in FIG. 5 and FIG. 6, one end portion of a conduction plate 96 made of metal is connected to an earthing portion 41 of the first printed circuit board 40. The conduction plate 96 serves as an example of a conductive member. The other end portion of the conduction plate 96 is attached to a below-described conduction plate 98 by a mounting screw 100.

Figure 3A:
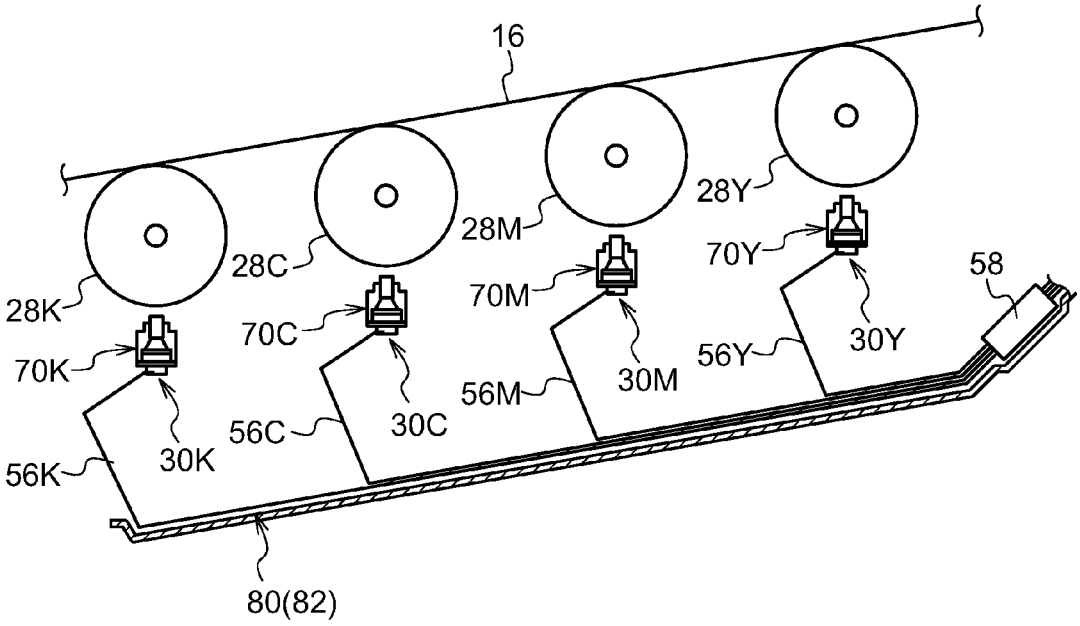
FIG. 3A is a schematic diagram illustrating mounting conditions of plural exposure devices.
Figure 3B:
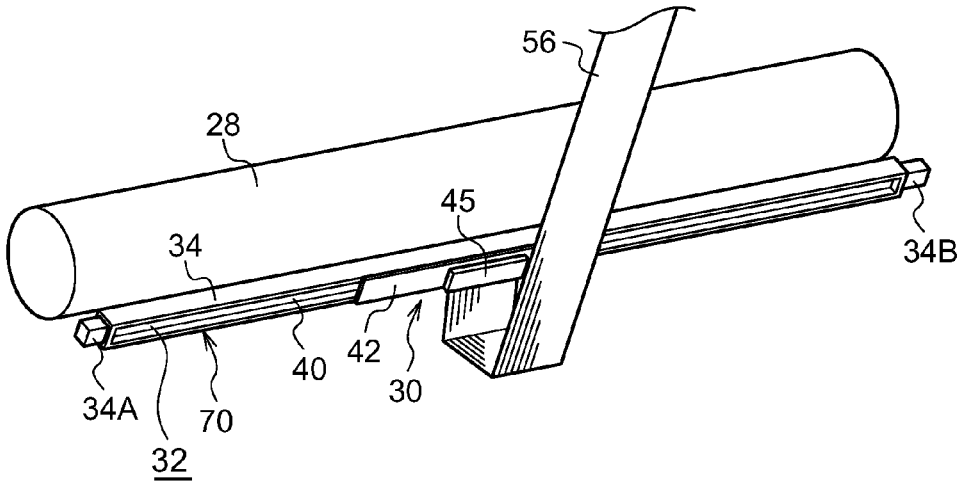
FIG. 3B is a schematic perspective view of an exposure device.

As illustrated in FIG. 2 and FIG. 3A, the SELFOC lens array 44 is fixed at the aperture portion 32 of the holder 34 at the emission face side of the LED array. The SELFOC lens array 44 is structured so as to focus the lights emitted from the LEDs onto the outer peripheral face of the photoreceptor 28.

The second printed circuit board 42 is electrically connected to the first printed circuit board 40 by wiring. The driver is soldered to a face of the second printed circuit board 42 that opposes the first printed circuit board 40. The connector 45, for connection of the one end portion of the FFC 56, is soldered to a face of the second printed circuit board 42 at the opposite side thereof from the face to which the driver is soldered. The connector 45 is disposed at a substantially central portion in the length direction of the exposure unit 70.

The FFC 56 has a structure in which a plural number of wires (conductive lines), which are disposed in parallel with intervals therebetween, are held between flexible strip-form insulators; for example, a structure in which tin-plated copper film is sandwiched by polyester tape. Additionally, an electromagnetic shielding member is applied to the surface of the FFC 56.

The FFCs 56Y to 56K that are connected to the exposure units 70Y to 70K, respectively, are gathered into two pairs of lines, the FFC 56Y and the FFC 56M, and the FFC 56C and the FFC 56K. These pairs are passed through a tubular ferrite core 58, which is a noise reduction component (a magnetic shield). As illustrated in FIG. 3A, the FFCs 56Y to 56K are disposed along the floor plate 82 and the ferrite core 58 is disposed at the side of the front plate 86.

As illustrated in FIG. 5 and FIG. 6, one end portion of the conduction plate 98, which is an example of a conductive member and is made of metal, is touched against a rotation axle 28A of the photoreceptor 28. The other end portion of the conduction plate 98 is attached to the side plate 90. More specifically, the other end portion of the conduction plate 96 whose one end portion touches against the earthing portion 41 of the first printed circuit board 40 is attached to an intermediate portion of the conduction plate 98 by the mounting screw 100, and the other end portion of the conduction plate 98 is attached to the side plate 90 by a mounting screw 102.

Next, operation of the image forming device 10 relating to the present exemplary embodiment is described. First, an image forming procedure at the image forming device 10 is described. As illustrated in FIG. 1, when the respective units of the image forming device 10 are in operational states, image data, to which image processing has been applied by the control section 36, is converted to colorant gradation data of the respective colors and is serially outputted to the exposure devices 30.

At the exposure devices 30, the exposure unit 70 corresponding to the colorant gradation data of each color emits respective exposure lights and exposes the outer peripheral face of the respective photoreceptor 28, which has been charged up by the charging roller 72. Thus, an electrostatic latent image is formed on the outer peripheral face of each photoreceptor 28.

The electrostatic latent image formed on the outer peripheral face of the respective photoreceptor 28 is developed (visualized) as a toner image (developer image) of the respective color of yellow (Y), magenta (M), cyan (C) and black (K) by the developing roller 78. Then, the respective color toner images that have been sequentially formed on the photoreceptors 28 of the image forming units 12Y to 12K are sequentially superposedly transferred onto the intermediate transfer belt 16 by the four first transfer rollers 18Y to 18K.

The color toner images that have been superposedly transferred onto the intermediate transfer belt 16 are second-transferred by the second transfer roller 20 to recording paper P that has been conveyed thereto from the paper supply section 46. The color toner image on the recording paper P is fixed by the fixing unit 60 (the heating roller 62 and the pressure roller 64), and the fixed recording paper P is ejected to the ejection portion 67 by the ejection roller 66. From the outer peripheral face of the photoreceptor 28 from which the first transfer of the toner image has been completed, residual toner, paper dust and the like are removed by the cleaning blade 76.

Next, (operation of) the earthing structure of each exposure device 30 and photoreceptor 28 is described. As illustrated in FIG. 5 and FIG. 6, the earthing portion 41 of the first printed circuit board 40 of the exposure unit 70 is electrically connected to the side plate 90 via the conduction plates 96 and 98 made of metal, and the side plate 90 is joined to the floor plate 82 via the plate springs 92 and 94 made of metal. Thus, the earthing portion 41 of the first printed circuit board 40 of the exposure unit 70 is electrically connected to the floor plate 82 via the side plate 90.

Therefore, the first printed circuit board 40 of the exposure unit 70 at which noise of electromagnetic waves and the like is generated may be connected to earth directly and at a short distance, and noise generated from the first printed circuit board 40 may be moderated. Accordingly, electromagnetic waves from the first printed circuit board 40 may be suppressed or prevented.

Furthermore, an electromagnetic shield member is applied to the surface of the FFC 56 connected to the second printed circuit board 42 of the exposure unit 70 and, as illustrated in FIG. 3A, the FFC 56 is disposed along the floor plate 82 and the front plate 86 of the metal plates 80. Therefore, compared to a structure in which the FFC 56 is guided through empty space, noise of electromagnetic waves and the like radiated (emitted) from the FFC 56 may be further suppressed or prevented.

As illustrated in FIG. 4, the side plate 90 is also screw-fastened and joined to the ceiling plate 84. Thus, the earthing portion 41 of the first printed circuit board 40 of the exposure unit 70 is also electrically connected to the ceiling plate 84, via the side plate 90. Therefore, noise generated from the first printed circuit board 40 of the exposure unit 70 may be even further moderated.

As illustrated in FIG. 5 and FIG. 6, the rotation axle 28A of the photoreceptor 28 is also electrically connected to the side plate 90, via the conduction plate 98 to which the conduction plate 96 is attached. Therefore, the rotation axle 28A of the photoreceptor 28 is also electrically connected to the floor plate 82 and the ceiling plate 84 (i.e., is earthed) via the side plate 90. Thus, because the rotation axle 28A of the photoreceptor 28 is connected to ground by a minimum distance, in comparison with when wiring links up a plural number of the photoreceptors 28, electromagnetic noise due to the wiring acting like an antenna may be moderated and noise of static electricity and the like may be moderated.

The earthing portion 41 of the first printed circuit board 40 of the exposure unit 70 and the rotation axle 28A of the photoreceptor 28 are earthed, via the side plate 90, to the floor plate 82 and ceiling plate 84 of the metal plates 80 that cover the image forming units 12, the transfer unit 14 and the like. Therefore, members and the like for earthing these units need not be separately provided. Hence, savings of space and reductions of fabrication costs of the image forming device 10 are enabled.

Moreover, in this structure, the other end portion of the conduction plate 96 is attached to an intermediate portion of the conduction plate 98 and only the other end portion of the conduction plate 98 is attached to the side plate 90, rather than the other end portions of the conduction plates 96 and 98 being respectively separately attached to the side plate 90. Therefore, an improvement in ease of assembly of the image forming unit 12 itself is enabled.

A structure is possible in which an earthing portion provided at a corner portion of another printed circuit board, at the control section 36 disposed at the top face of the ceiling plate 84, is screw-fastened to a bracket 84A provided at a corner portion of the ceiling plate 84 (see FIG. 4). Thus, the printed circuit board may be fixed to the ceiling plate 84 and the earthing portion thereof electrically connected to the side plate 90 via the ceiling plate 84

Thus, because the earthing portion of this printed circuit board may be earthed to the floor plate 82 via the side plate 90, similarly to the above descriptions, members and the like for earthing the earthing portion of this printed circuit board need not be separately provided, and savings of space and reductions of fabrication costs are enabled.

Hereabove, the image forming device 10 relating to the present exemplary embodiment has been described on the basis of the example illustrated in the drawings. However, the image forming device 10 relating to the present exemplary embodiment is not to be limited by the example in the drawings. For example, the image forming units 12Y, 12M, 12C and 12K are not to be limited to being arranged in a diagonal direction, and may be arranged in a vertical direction or a horizontal direction or the like. Further, the main body portion of each image forming unit 12 may have an integrated structure that is not divided into the upper housing 15 and the lower housing 13.

What is claimed is:

1. An image forming device comprising:

a plurality of exposure components at which pluralities of light emitting elements are disposed on substrates, the exposure components exposing a plurality of exposure objects, respectively; and a conductive covering member including at least a floor plate that covers the exposure components from below, wiring connected to the substrates being disposed along the floor plate, and earthing portions of the substrates being electrically connected to the floor plate.

2. The image forming device of claim 1, wherein the covering member includes a side plate that covers an axial direction side of the exposure objects and is joined to the floor plate, and the earthing portions of the substrates are electrically connected to the side plate via conductive members.

3. The image forming device of claim 2, wherein the conductive members are electrically connected to rotation axles of the exposure objects.

4. The image forming device of claim 3, wherein the covering member includes a ceiling plate that covers the exposure objects from above and is joined to the side plate, and the earthing portions of the substrates and the rotation axles are electrically connected to the ceiling plate via the side plate.

* * * * *